US008960369B1

(12) United States Patent
Agsalud

(10) Patent No.: US 8,960,369 B1
(45) Date of Patent: Feb. 24, 2015

(54) AIR ACCELERATING SYSTEM

(76) Inventor: Tyrone I. S. Agsalud, Tamunung, GU (US)

( * ) Notice: Subject to any disclaimer, the term of this patent is extended or adjusted under 35 U.S.C. 154(b) by 337 days.

(21) Appl. No.: 13/361,933

(22) Filed: Jan. 30, 2012

(51) Int. Cl.
*F16N 33/00* (2006.01)
*F04B 23/14* (2006.01)

(52) U.S. Cl.
USPC ..... 184/1.5; 417/86

(58) Field of Classification Search
CPC . F01M 11/0458; F01M 11/045; F01M 11/04; F04D 9/06; F04D 9/065; B65B 1/12; B65B 31/04; B65B 31/041
USPC ..... 184/1.5, 31, 55.1; 417/86, 89, 201; 141/65, 67
See application file for complete search history.

(56) References Cited

U.S. PATENT DOCUMENTS 1,716,288 A * 6/1929 Wilderman ..... 134/5
2,936,948 A * 5/1960 Eck ..... 415/218.1
D263,050 S 2/1982 Chang
4,678,410 A * 7/1987 Kullen ..... 417/423.1
4,889,248 A * 12/1989 Bennett ..... 215/390
4,951,784 A 8/1990 Bedi
5,062,398 A 11/1991 Bedi et al.
5,190,120 A 3/1993 Watts
5,467,746 A * 11/1995 Waelput et al. ..... 123/196 A
5,921,213 A * 7/1999 Grigorian et al. ..... 123/196 A
6,011,903 A * 1/2000 Nosenchuck ..... 392/385
6,213,173 B1 4/2001 Bedi et al.
6,298,947 B1 10/2001 Flynn
7,422,021 B2 * 9/2008 Leaphart ..... 134/22.18
7,467,689 B1 * 12/2008 Batten, Jr. et al. ..... 184/1.5
8,616,842 B2 * 12/2013 Avedon ..... 415/209.2
2004/0211626 A1 10/2004 Waelput

* cited by examiner

*Primary Examiner* — William E Dondero
*Assistant Examiner* — Minh Truong

(57) ABSTRACT

An air accelerating system includes a housing that has a bore extending through top and bottom ends of the housing. A mounting collar mounted on the bottom end fluidly couples the housing to an oil fill hole of a valve cover. An axle mounted in the bore has a plurality of main blades mounted thereon which are rotated when the axle is rotated to exhaust air from the bottom end to blow oil out of engine valves and into an oil pan of an engine. A drive mount mounted to the top end has at least one vent aperture extending therethrough that is in fluid communication with the bore. A drive spindle rotatably mounted to the drive mount is engaged with the axle and engageable with a drill. The drill rotates the axle to draw air into the vent aperture and expel it outwardly of the bottom end.

7 Claims, 8 Drawing Sheets

AIR ACCELERATING SYSTEM

BACKGROUND OF THE INVENTION

1. Field of the Invention

The present invention relates to engine oil purging systems and more particularly pertains to a new engine oil purging system for accelerating air entering a valve cover to force oil in an engine into an oil pan of the engine when the oil is being changed.

2. Description of the Prior Art

The use of engine oil purging systems is known in the prior art. While these devices fulfill their respective, particular objectives and requirements, the need remains for a system that has certain improved features that include a mounting collar that is quickly coupled to a valve cover to seal around an oil fill hole. Additionally, the system should include a plurality of blades to accelerate the air passing through the system and entering the valve cover.

SUMMARY OF THE INVENTION

The present invention meets the needs presented above by generally comprising a housing that has a bore extending through a top end and a bottom end of the housing. A mounting collar is mounted to the housing. The mounting collar is positioned adjacent the bottom end of the housing and extends through an oil fill hole to be secure the housing to a valve cover. An axle is positioned in the bore of the housing and is aligned with a longitudinal axis of the housing. A plurality of main blades is coupled to the axle. The main blades are rotated when the axle is rotated to accelerate the air being drawn from the top end of the housing and exhausted from the bottom end to blow oil out of engine valves and into an oil pan of an engine. A drive mount is removably mounted to the top end of the housing. The drive mount has at least one vent aperture extending therethrough that is in fluid communication with the bore. A drive spindle extends through and is rotatably mounted to the drive mount. The drive spindle has a drill end extending upwardly from the drive mount and a drive end engaging the axle when the drive mount is mounted to the top end of the housing. The drill end is removably engageable with an electric drill and is rotatable by the electric drill to rotate the axle along with the main blades to draw air into the vent aperture and push the air outwardly of the bottom end of the housing.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
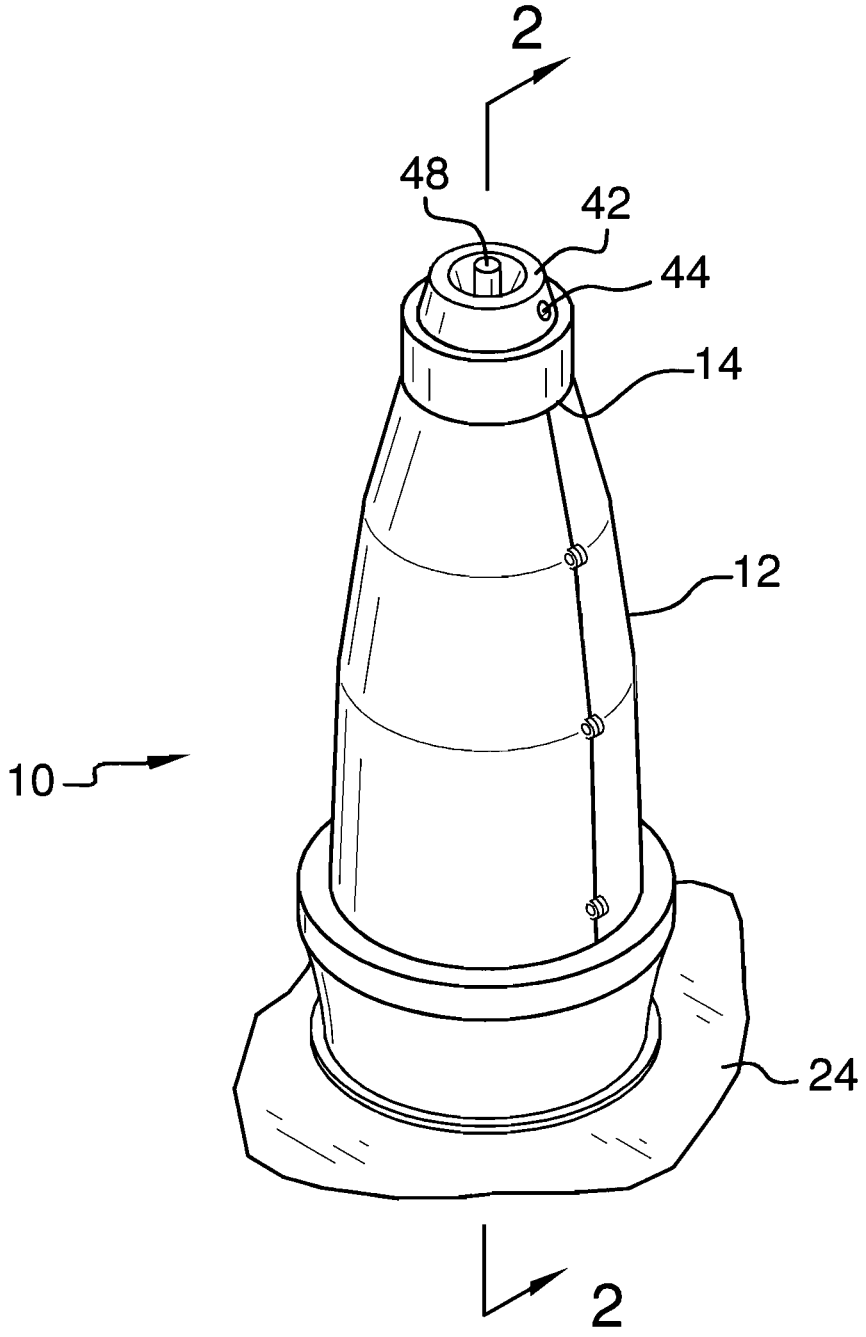
FIG. 1 is a perspective view of an embodiment of air accelerating system according to the present invention.
Figure 2:
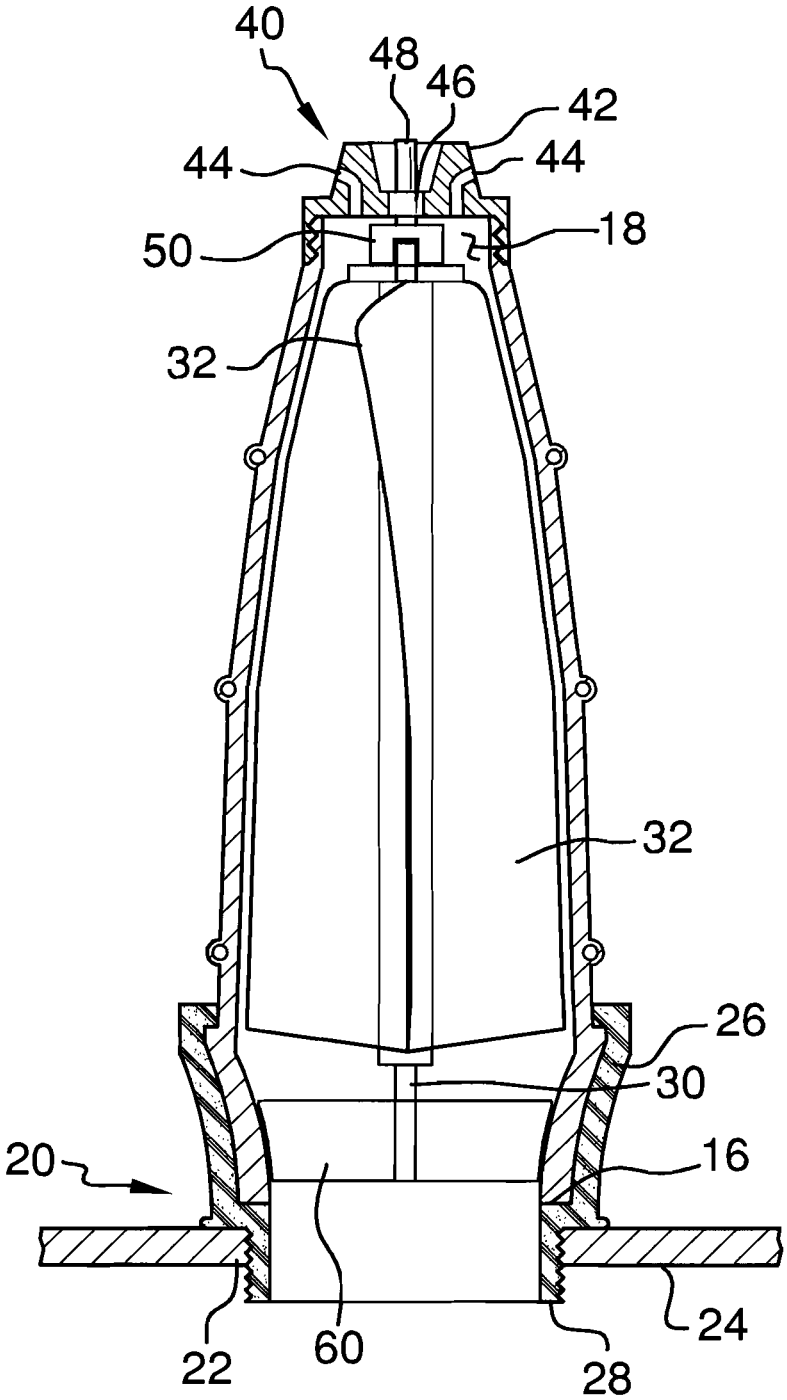
FIG. 2 is a cross-sectional view of the drive mount of the present invention with the drill fixture inserted.
Figure 3:
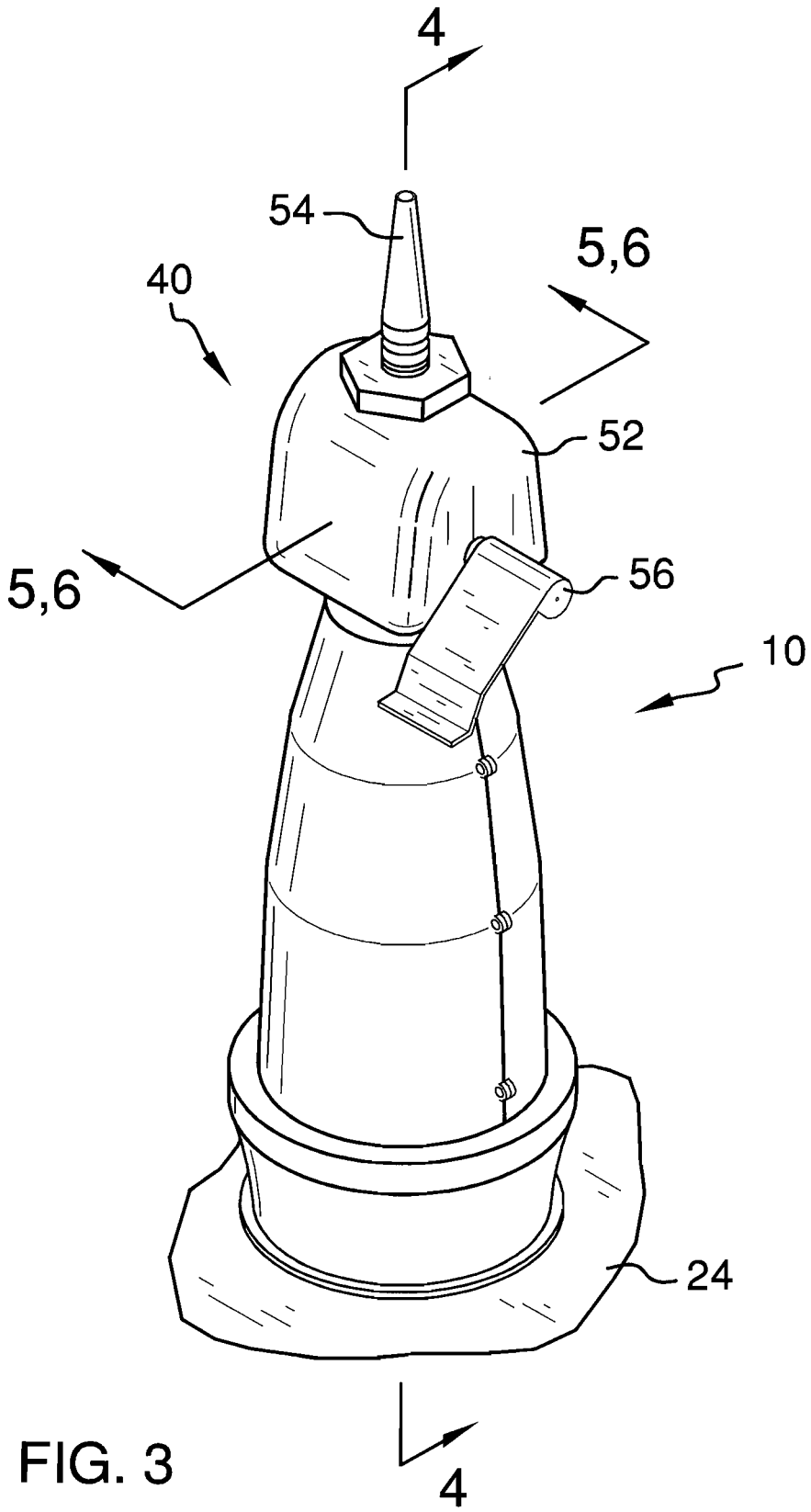
FIG. 3 is a perspective view of an embodiment of the present invention.
Figure 4:
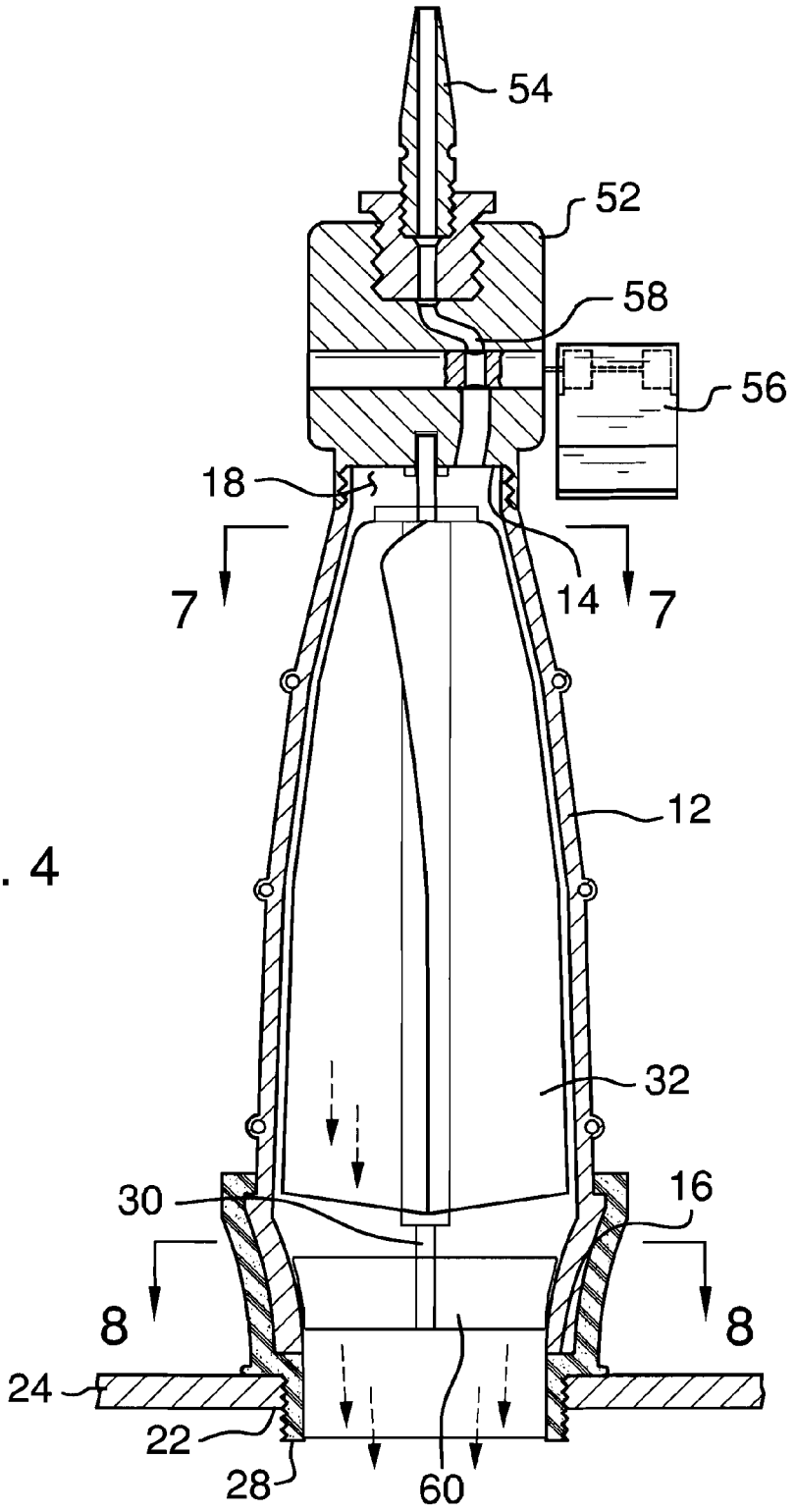
FIG. 4 is a cross-sectional view the embodiment of the present invention taken along line 4-4 of FIG. 3.
Figure 5:
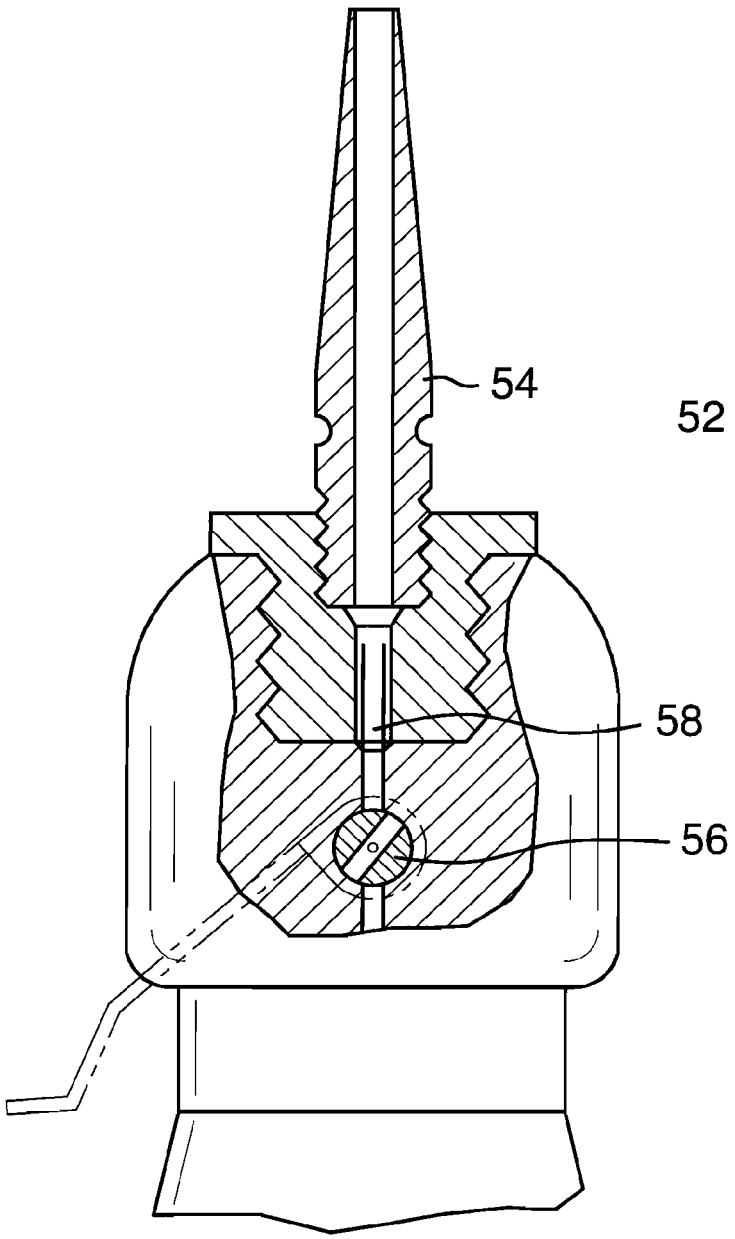
FIG. 5 is a perspective view of the present invention with the housing and mounting collar shown in cross-section.
Figure 6:
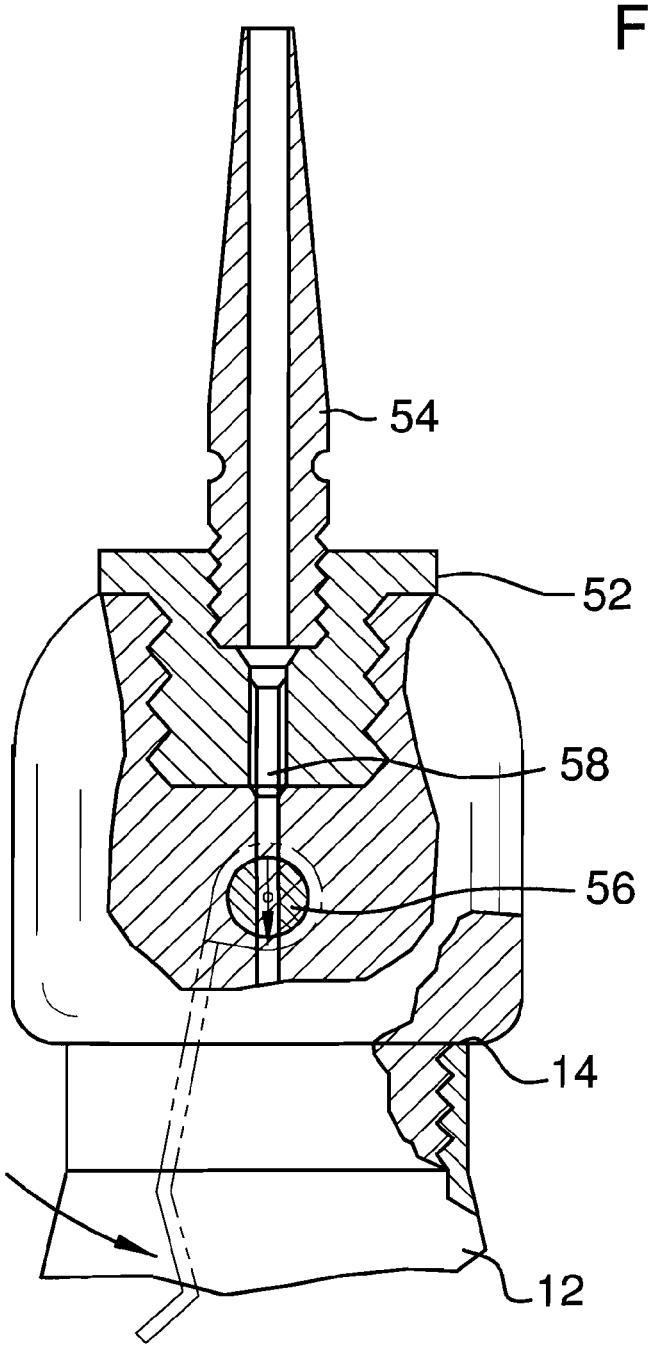
FIG. 6 is an enlarged cross-sectional and broken view of one of the support assemblies of the present invention.
Figure 7:
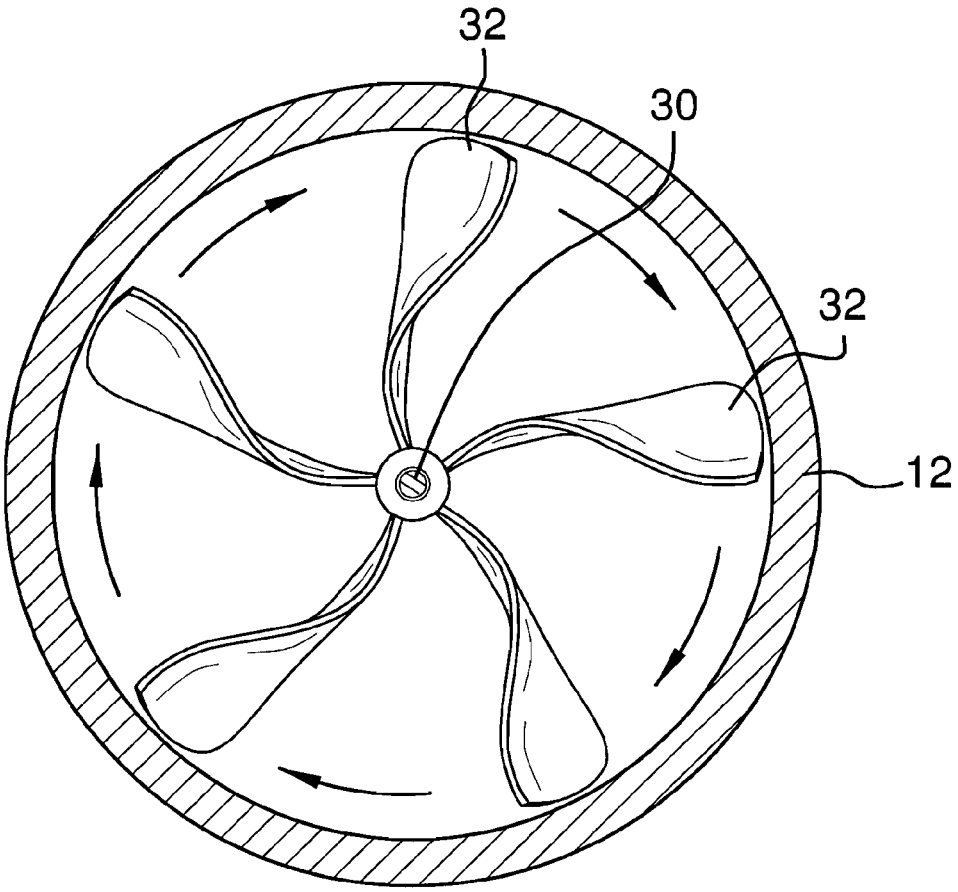
FIG. 7 is a cross-sectional of the present invention along line 7-7 of FIG. 4.
Figure 8:
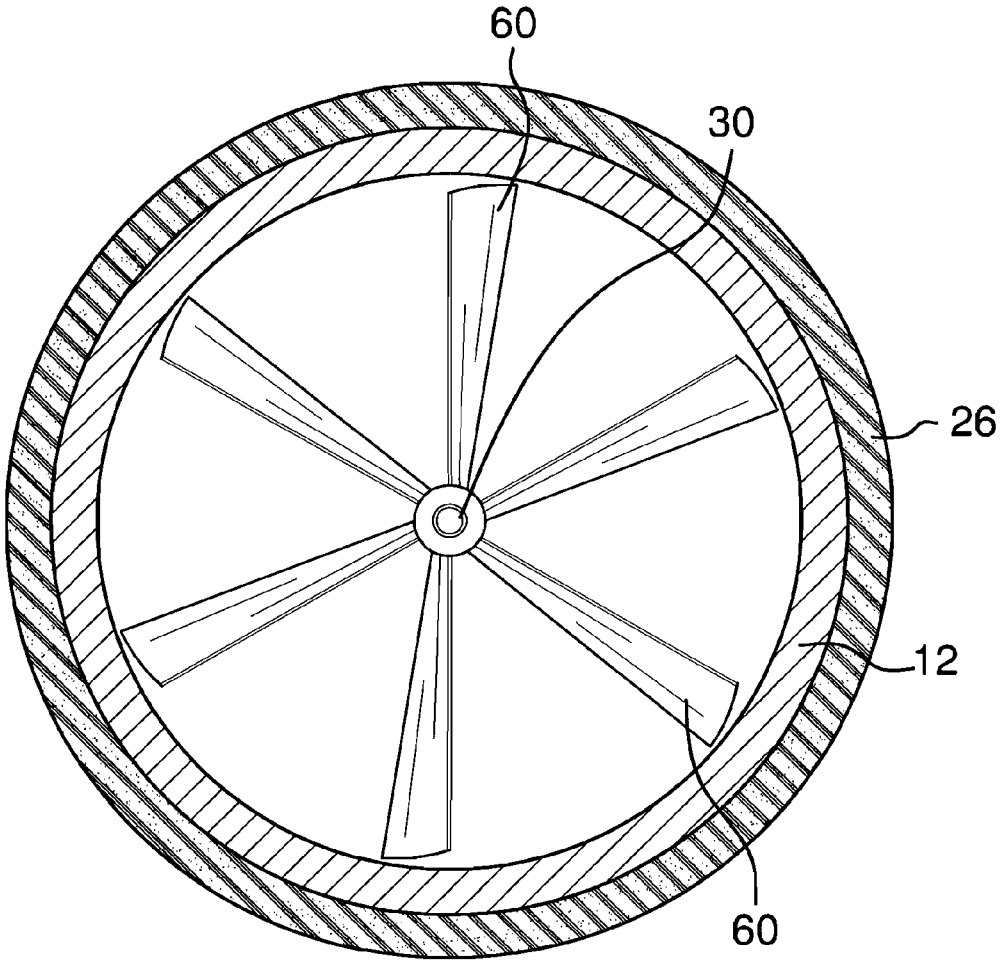
FIG. 8 is a cross-sectional of the present invention along line 8-8 of FIG. 4.

With reference now to the drawings, and in particular to FIGS. 1 through 8 thereof, a new engine oil purging system embodying the principles and concepts of the present invention and generally designated by the reference numeral 10 will be described.

As best illustrated in FIGS. 1 through 8, the air accelerating system 10 generally comprises a housing 12 that has a bore 18 therein that extends through a top end 14 and a bottom end 16 of the housing 12. The housing 12 may include a majority portion adjoining the top end 14 which is frusto-conical in shape and which tapers outwardly from the top end 14 toward the bottom end 16 and a minority portion adjoining the bottom end 16 and tapering inwardly from the majority portion to the bottom end 16. This causes air driven into the top end to increase in pressure at it transfers from the majority portion to the minority portion.

A mounting collar 20 is mounted to the housing 12. The mounting collar 20 is positioned adjacent the bottom end 16 of the housing 12 and extends through an oil fill hole 22. The mounting collar 20 is securable to a valve cover 24 of an engine to secure the housing 12 to the valve cover 24. The mounting collar 20 is comprised of a compressible material to form a seal against the valve cover 24 to inhibit air leaking out between the mounting collar 20 and the valve cover 24. The mounting collar 20 includes a body section 26 and a threaded shoulder 28 downwardly extending from the body section 26. The shoulder 28 threadably engages the valve cover 24 adjacent to the oil fill hole 22 to secure the body section 26 and the housing 12 to the valve cover 24. A combined height of the housing 12 and the mounting collar 20 is between 10 cm and 20 cm.

An axle 30 is positioned in the bore 18 of the housing 12. The axle 30 is aligned with a longitudinal axis of the housing 12. A plurality of main blades 32 is coupled to the axle 30 and the main blades 32 are vertically elongated along the axle 30. Each of the main blades 32 is rotated when the axle 30 is rotated to act as an impeller to accelerate the air is drawn from the top end 14 of the housing 12 and exhausted from the bottom end 16 to blow oil out of engine valves and into an oil pan of the engine. The air is accelerated as the air passes by the main blades 32.

The system 10 may comprise a kit which includes a pair of provided heads 40. Each of the heads 40 is removably couplable to the top end 14 of the housing 12 and more particularly may be threadably coupled to the top end 14. Each of the heads 40 enables air to be driven into the bore 18 and outwardly of the bottom end 16. Only one of the heads 40 is usable at a time.

The pair of heads 40 includes a drive mount 42 that is removably mounted to the top end 14 of the housing 12. The drive mount 42 has vent apertures 44 extending therethrough that are in fluid communication with the bore 18. A drive spindle 46 extends through and is rotatably mounted to the drive mount 42. The drive spindle 46 has a drill end 48 extending upwardly from the drive mount 42 and a drive end 50 engaging the axle 30 when the drive mount 42 is mounted to the top end 14 of the housing 12. The drill end 48 is removably engageable with a conventional electric drill. The drive spindle 46 is rotatable by the electric drill to rotate the axle 30 along with the main blades 32 to draw air into the vent apertures 44 and push the air outwardly of the bottom end 16 of the housing 12. The drill end 48 may either be coupled to the drill chuck or it may be formed to receive a bit attached to the drill.

The other of the pair of heads 40 includes an air funnel 52 that is removably mountable to the top end 14 of the housing 12. The air funnel 52 includes a receiver 54 extending upwardly from the air funnel 52. The receiver 54 is in fluid communication with the bore 18 when the air funnel 52 is mounted on the housing 12. The receiver 54 is fluidly engageable with a compressed air line to allow compressed air to direct through the receiver 54 and into the bore 18 to push air outwardly of the bottom end 16 of the housing 12. A valve 56 is mounted on the air funnel 52 and is in communication with the receiver 54 to selectively open or close an air conduit 58 fluidly connecting the receiver 54 and the bore 18. The air funnel 52 provides a tight fit between the compressed air line and the oil fill hole 22.

A plurality of fan blades 60 is coupled to and radiate outwardly from the axle 30. The fan blades 60 are positioned adjacent to the bottom end 16 of the housing 12 and are rotated when the axle 30 is rotated. The fan blades 60 accelerate the air that has passed through the housing 12 into the valve cover 24 to force the air into the valve cover 24.

In use, the shoulder 28 of the mounting collar 20 is inserted into the oil fill hole 22 of the valve cover 24 to secure the mounting collar 20 and the housing 12 to the valve cover 24. The drive mount 42 is coupled to the top end 14 of the housing 12 so that that the drive spindle 46 engages the axle 30. A drill is then engaged with the drive spindle 46 to rotate the axle 30 and pull air into the bore 18 and exhaust it out of the bottom end 16 of the housing 12 to force the oil in the valves to the oil pan to be drained. If a compressed air supply is available, it may be used with the air funnel 52 to direct air through the housing 12 and into the oil fill hole 22.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An air accelerating system for forcing oil out of an engine during an oil change, said system comprising:

a housing having a bore extending through a top end and a bottom end of said housing;

a mounting collar being mounted to said housing, said mounting collar being positioned adjacent said bottom end of said housing, said mounting collar extending through an oil fill hole and securing to a valve cover of the engine to secure said housing to the valve cover, said mounting collar being comprised of a compressible material to form a seal against the valve cover to inhibit air leaking out between said mounting collar and the valve cover, said mounting collar including a body section and a threaded shoulder downwardly extending from said body section, said shoulder threadably engaging the valve cover adjacent to the oil fill hole to secure said body section and said housing to the valve cover, a combined height of said housing and said mounting collar being between 10 cm and 20 cm;

an axle being positioned in said bore of said housing, said axle being aligned with a longitudinal axis of said housing;

a plurality of main blades being coupled to said axle, said main blades being vertically elongated along said axle, each of said main blades being rotated when said axle is rotated to accelerate the air being drawn from said top end of said housing and exhausted from said bottom end to blow oil out of engine valves and into an oil pan of the engine, the air being accelerated as the air passes through said main blades;

a drive mount being removably mounted to said top end of said housing, said drive mount having vent apertures extending therethrough and being in fluid communication with said bore, a drive spindle extending through and being rotatably mounted to said drive mount, said drive spindle having a drill end extending upwardly from said drive mount and a drive end engaging said axle when said drive mount is mounted to said top end of said housing, said drill end being removably engageable with an electric drill, said drive spindle being rotatable by the electric drill to rotate said axle along with said main blades to draw air into said vent apertures and push the air outwardly of said bottom end of said housing; and a plurality of fan blades being coupled to and radiating outwardly from said axle, said fan blades being positioned adjacent to said bottom end of said housing, said fan blades being rotated when said axle is rotated, said fan blades accelerating the air that has passed through said housing into the valve cover to force the air into the valve cover.

2. An air accelerating system for forcing oil out of an engine during an oil change, said system comprising:

a housing having a bore extending through a top end and a bottom end of said housing;

a mounting collar being mounted to said housing, said mounting collar being positioned adjacent said bottom end of said housing, said mounting collar extending through an oil fill hole and securing to a valve cover of the engine to secure said housing to the valve cover;

an axle being positioned in said bore of said housing, said axle being aligned with a longitudinal axis of said housing;

a plurality of main blades being coupled to said axle, each of said main blades being rotated when said axle is rotated to accelerate the air being drawn from said top end of said housing and exhausted from said bottom end to blow oil out of engine valves and into an oil pan of the engine;

a drive mount being removably mounted to said top end of said housing, said drive mount having at least one vent aperture extending therethrough and being in fluid communication with said bore, a drive spindle extending through and being rotatably mounted to said drive mount, said drive spindle having a drill end extending upwardly from said drive mount and a drive end engaging said axle when said drive mount is mounted to said top end of said housing, said drill end being removably engageable with an electric drill, said drive spindle being rotatable by the electric drill to rotate said axle along with said main blades to draw air into said vent aperture and push the air outwardly of said bottom end of said housing.

3. The system according to claim 2, wherein said mounting collar is comprised of a compressible material to form a seal against the valve cover to inhibit air leaking out between said mounting collar and the valve cover.

4. The system according to claim 3, wherein said mounting collar includes a body section and a threaded shoulder downwardly extending from said body section, said shoulder threadably engaging the valve cover adjacent to the oil fill hole to secure said body section and said housing to the valve cover.

5. The system according to claim 2, wherein said mounting collar includes a body section and a threaded shoulder downwardly extending from said body section, said shoulder threadably engaging the valve cover adjacent to the oil fill hole to secure said body section and said housing to the valve cover.

6. The system according to claim 2, wherein said main blades are vertically elongated along said axle.

7. The system according to claim 2, further including a plurality of fan blades being coupled to and radiating outwardly from said axle, said fan blades being positioned adjacent to said bottom end of said housing, said fan blades being rotated when said axle is rotated, said fan blades accelerating the air that has passed through said housing into the valve cover to force the air into the valve cover.

* * * * *